United States Patent [19]

Andrews

[11] Patent Number: 4,545,582

[45] Date of Patent: Oct. 8, 1985

[54] TRANSLUCENT ELECTRONIC BOARD GAME WITH MAGNETIC PAWN

[76] Inventor: Walter H. Andrews, 8920 Becker, Allen Park, Mich. 48101

[21] Appl. No.: 459,455

[22] Filed: Feb. 25, 1983

[51] Int. Cl.[4] ..... A63F 3/00

[52] U.S. Cl. ..... 273/238; 273/239; 273/249; 273/288

[58] Field of Search ..... 273/237, 238, 239, 248, 273/249, 243

[56] References Cited

U.S. PATENT DOCUMENTS

| | | | |
|---|---|---|---|
| 1,268,397 | 6/1918 | Sigler . | |
| 1,627,173 | 5/1927 | Haaz | 273/249 |
| 2,081,020 | 5/1937 | Sass . | |
| 2,525,738 | 10/1950 | Tormey | 273/239 X |
| 2,799,505 | 7/1957 | Lyons | 273/238 |
| 3,195,894 | 7/1965 | Alsaker et al. | 273/239 |
| 3,508,753 | 4/1970 | Mackey . | |
| 3,733,074 | 5/1973 | Daley | 273/238 |
| 3,735,986 | 5/1973 | Glass et al. | 273/249 |
| 3,764,145 | 10/1973 | Schrafft . | |
| 4,101,131 | 7/1978 | Barnby . | |

FOREIGN PATENT DOCUMENTS

| | | | |
|---|---|---|---|
| 6183 | of 1910 | United Kingdom | 273/239 |

*Primary Examiner*—Richard C. Pinkham

*Assistant Examiner*—Scott L. Brown

*Attorney, Agent, or Firm*—Joseph J. Goluban

[57] ABSTRACT

An electronic board game comprising a flat horizontal translucent surface with a light source, a plurality of playing pieces and a hand held mover object. The translucent surface has an array of playing positions located on it's top surface and a plurality of light sources located thereunder. The light source consists of a bulb in series with a reed switch and energy source. The playing pieces consist of a magnetic pawn type object, with all pawns having the same polarity at their tops. The hand held mover object contains a magnet having the same polarity at it's top as the playing pieces, therefore, when the mover object is placed in close proximity to a playing piece it will repel it along the board's surface across the plurality of playing positions. The mover object can take the form of a ring, pistol, finger or any other shape, depending on the game logo. The light source is activated by the magnetic flux of the playing piece as it advances over a playing position having a reed switch located thereunder. The playing piece magnetic flux permeates the translucent game board surface causing the reed switch to close, thus energizing the light bulb disposed in series with the reed switch and energy source. As the light from the bulb permeates the translucent game board surface a message in the form of words or drawings is communicated to the player.

22 Claims, 11 Drawing Figures

TRANSLUCENT ELECTRONIC BOARD GAME WITH MAGNETIC PAWN

BACKGROUND OF THE INVENTION

This invention relates to a new and useful improvement in electronic board games, with magnetic pawn playing pieces. The movement of the playing pieces has traditionally been accomplished by a player moving it by hand, with no further interaction of the playing piece with the game board. Thus, after playing the game many times the player becomes bored with it and loses interest, since no particular skill is required in the movement of the playing piece.

It is well known in the art that a permanent magnet emits an external magnetic field which can either attract or repel other magnetically charged objects, or attract iron type objects. It is therefore, possible to use a hand held permanent magnet to either repel or attract a magnetic type playing piece without touching it.

Further, it is also well known in the art that a permanent magnet emits a magnetic field which is capable of permeating various types of materials, such as translucent plastics.

Therefore, an object such as an electronic reed switch placed under a game board's surface can be activated due to the magnetic field emitted by a magnetic pawn playing piece as it is brought into close proximity thereof. The reed switch being connected in series to an energy source and the light bulb causes the light bulb to light when the reed switch is closed. Thus, unlikeother prior art games a player using my invention is challenged by the skill required to move the playing pieces along the surface of the game board within the play area boundaries.

Further, the player is intrigued by the almost magic effect of the activation of the numerous light sources as the many playing pieces deploy on the game board surface and are brought into close proximity to the light source without the player touching it.

SUMMARY OF THE INVENTION

It is the object of the present invention to provide a new and improved game.

Another object of the present invention is to provide a new and unique game for entertainment, that uses magnetic pawn type playing pieces.

Another object of the present invention is to provide a new and unique game wherein a magnetic pawn is advanced along the playing board surface by a hand held mover object, without touching it.

Another object of the present invention is to provide a new and unique game which has a magnetic mover object with the same polarity at it's top as the magnetic pawn playing piece.

Another object of the present invention is to provide a new and unique game wherein the advancement of the playing piece along the game board's playing surface requires the use of judgment and skill by the player.

Another object of the present invention is to provide a new and unique game wherein the surface of the game board is made from a translucent plastic material.

Still another object of the present invention is to provide a new and unique game whereby lights located under the translucent plastic game board surface are activated as the playing piece is advanced along the game board.

Still another object of the present invention is to provide a new and unique game wherein a reed switch, light bulb, and energy source is placed in an electric series circuit.

Yet another object of the present invention is to provide a new and unique game which uses a battery as the energy source.

Yet another object of the present invention is to provide a new and unique game which uses household AC current as the energy source.

A further object of the present invention is to provide a new and unique game wherein the mover object can take the form of a ring, finger, or any other form depending on the game logo.

A further object of the present invention is to provide a new and unique game wherein the playing piece magnetic flux permeates the translucent game board medium, causing a reed switch to be activated, which in turn closes the electric circuit leading to the energy source and light bulb.

A still further object of the present invention is to provide a new and unique game whereby the playing pieces all have the same polarity at their top.

A still further object of the present invention is to provide a new and unique game wherein the game board energy source may be turned on or off by a switch located on the game board.

A still further object of the present invention is to provide a new and unique game wherein the reed switches and lightbulbs are placed in a parallel electrical circuit with each other.

A still further object of the present invention is to provide a new and unique game with a colored plastic film being disposed between the bottom of the translucent surface and the light bulbs.

A still further object of the present invention is to provide a new and unique game wherein the colored plastic film has messages written thereon.

A still further object of the present invention is to provide a new and unique game which is simple in construction and inexpensive to manufacture.

Further objects and advantages of my invention will be apparent from the following description and appended claims, reference being made to the accompanying drawings forming a part of the specification, wherein like reference characters designate corresponding parts in several views.

It is to be understood, that the invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description and not of limitation.

DESCRIPTION OF THE PREFERRED EMBODIMENT

Figure 1:
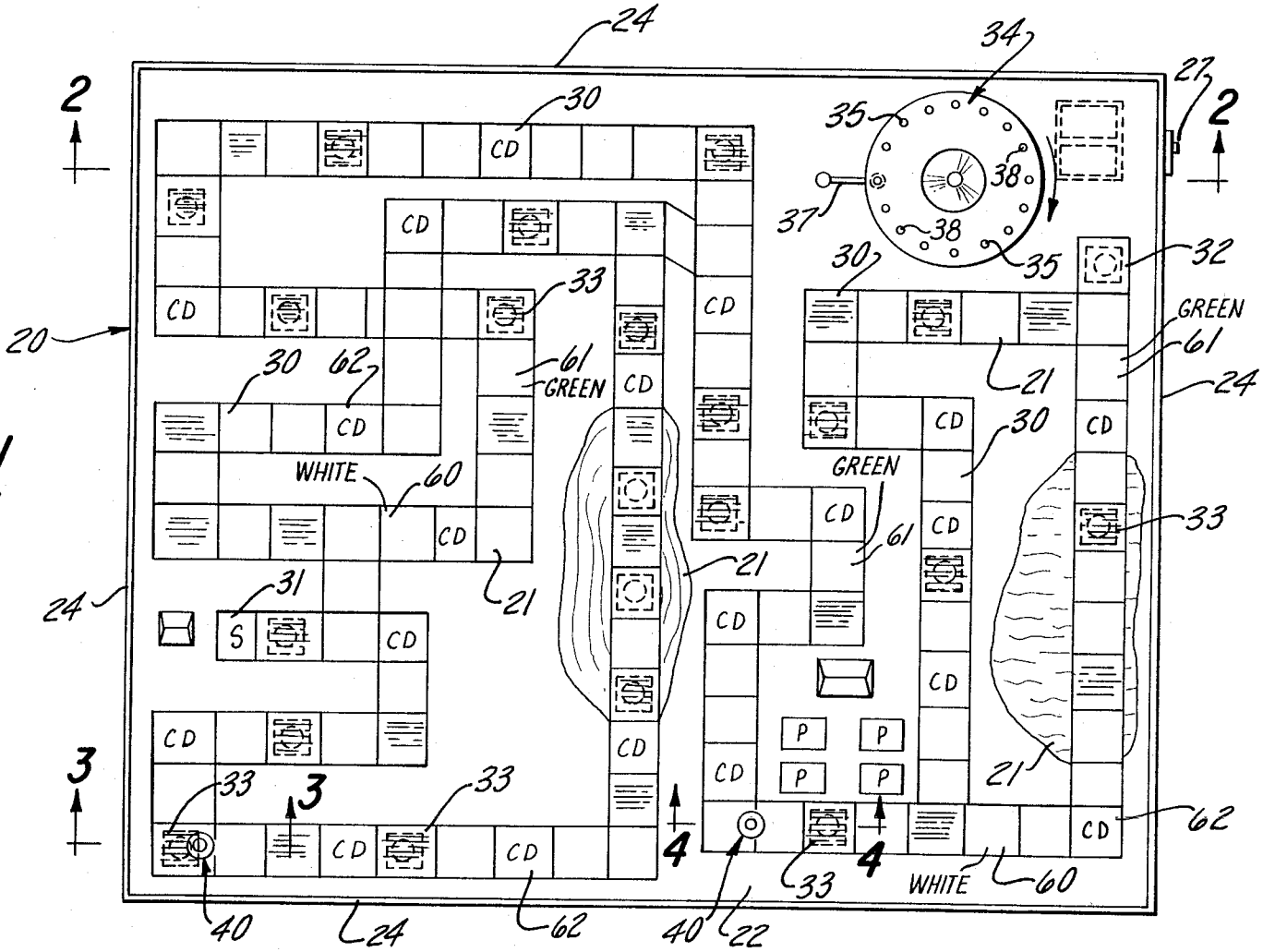
FIG. 1 is a plan view of the game board showing the location of the light bulbs and electrical reed switches by dashed lines and two playing pieces.
Figure 2:
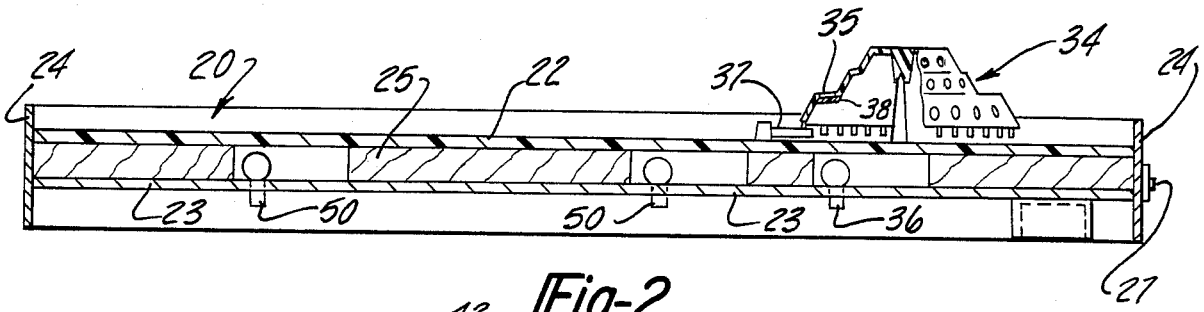
FIG. 2 is a cross section view taken along lines 2—2 in FIG. 1 of the drawings.
Figure 9:
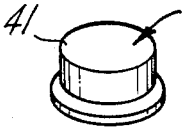
FIG. 9 is a perspective view of a magnet pawn playing piece.

Referring now to FIG. 1, there is an illustrated plan view of a preferred embodiment of the game board 20 which is comprised of two layers. The top layer playing surface 22, is a flat horizontal sheet of translucent material such as plastic having an array of play positions 30 on its surface. The playing positions 30 are arranged in a series of consecutive squares from start position 31 to finish position 32. The bottom layer 23, as best seen in FIG. 2 is a flat horizontal sheet of non-translucent material such as paper, fiber or cardboard. Both the playing surface 22 and the bottom layer 23 are secured in place between the frame 24 of game board 20 and are kept separate by means of a spacer 25. Located on the playing surface 22 of the game board 20 is a plurality of pawn shaped permanent magnet playing pieces 40 which can be best seen in FIG. 9. The magnetic pole sign at the top 41 of the play pieces 40 can be either positive (+) or negative (−), provided all the play pieces 40 have the same pole sign. However, as part of my preferred embodiment I have shown play pieces 40 having a positive (+) pole sign at their tops, as can be best seen in FIGS. 2, 3 and 9 of the drawings.

Figure 3:
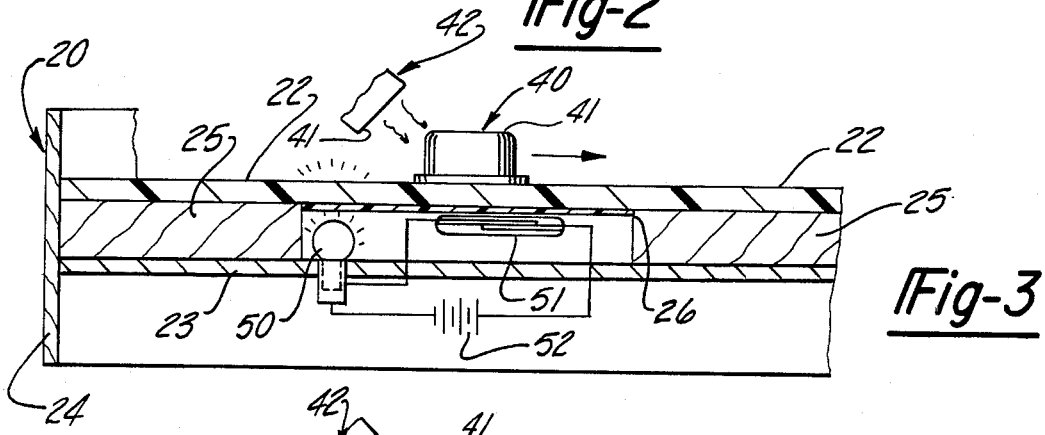
FIG. 3 is a fragmentary cross section view taken along section lines 3—3 in FIG. 1 of the drawings showing a reed switch in a closed position.
Figure 4:
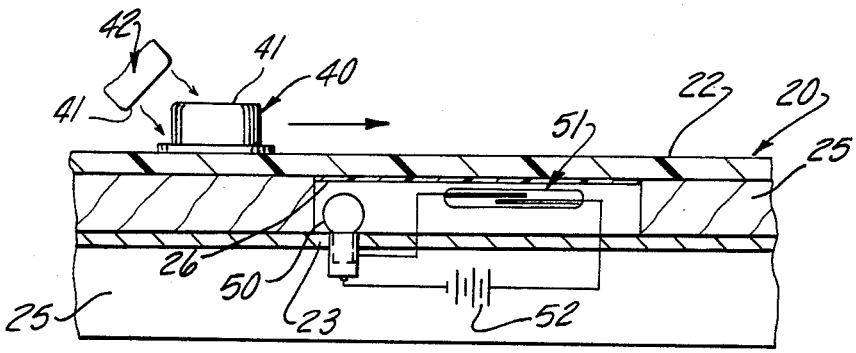
FIG. 4 is a fragmentary cross section view taken along section lines 4—4 in FIG. 1 of the drawings showing a reed switch in an open position.
Figure 5:
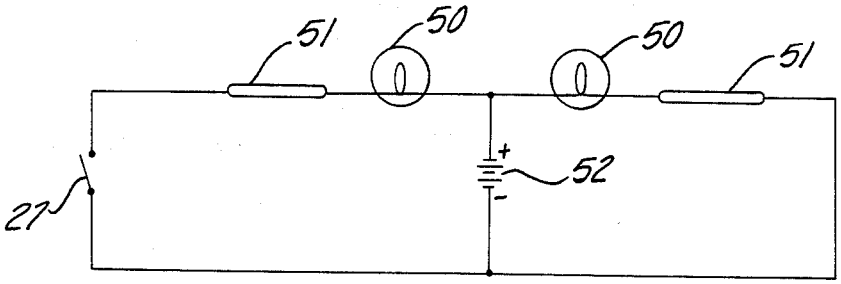
FIG. 5 is a diagrammatic view of the electrical circuit of the game board in a series parallel circuit.

Referring to FIGS. 3 and 4 a light bulb can best be seen disposed between the playing surface 22 and the bottom layer 23 of the game board 20. The light bulbs 50 are selectively placed under a plurality of light play positions 33 as can be best seen in FIG. 1. Also, located under each of the light play positions 33 are electrical reed switches 51. All of the reed switches 51 and the light bulbs 50 are placed in a parallel circuit to assure a continuous electrical energy source 52 in the event of a malfunctioning of any one of the reed switches 51 or light bulbs 50. Referring now to FIG. 5 of the drawings which is a diagrammatic view of the electrical circuit used in my game board 20 it can be seen that each light playing position 33 of the game board 20 consists of a light bulb 50 and a reed switch 51 which are in series with the energy source 52. The reed switch 51 is of the type that is well known in the electrical field prior art, and one such reed switch which known to the applicant is marketed under the trade name of PK 10 supplied by Archer, a subsidiary of Tandy Corp. The electrical energy source 52 used to activate the light bulb 50 may be of either a standard AC or DC type current well known in the prior art. As my preferred embodiment I have disclosed the use of two (2) standard type C 1.25 volt batteries.

In addition to the light bulbs 50 located under the light play positions 33 a spinner light bulb 36 is also used for the spinner 34 located near the finish position 32 on playing surface 22 of the game board 20. The spinner 34 is of a disc or saucer type configuration and is constructed to be capable of being spun about its apex by the game operator.

A plurality of holes 35 are disposed near the circumference of the spinner 34. The holes 35 are covered with a translucent type colored material 38 and as my preferred embodiment, I wish to disclose the use of red, blue, and green colors material 38. The spinner light bulb 36 is positioned so that it is directly in line with the spinner indicator 37 and underneath the spinner 34 holes 35. The spinner light bulb 36 is also part of the series parallel electrical circuit as the other light bulbs 50, and is activated when a magnet play piece 40 becomes advanced to the finish position 32 containing a reed switch 51 and light bulb 50, as can be best seen in FIG. 1 of the drawings.

Figure 10:
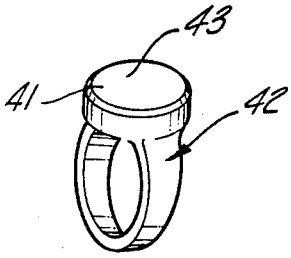
FIG. 10 is a perspective view of a magnet mover object in the form of a ring.

Referring now to FIG. 10 where a perspective view of a mover object 42 is shown in the form of a ring. The mover object 42 is used by the game operator to advance the magnet play piece 40 along the game board 20 between the play positions 30. Hidden within the mover object 42 is a permanent magnet 43 which is so disposed therein that its top 41 has the same polarity as the top 41 of the play piece 40. It is well known in the art that a permanent magnet emits a magnetic flux or field which is capable of either attracting or repelling other magnetically charged objects. Therefore, as part of my preferred embodiment I wish to disclose the use of a hand held mover object 42 which utilizes a permanent magnet 43 and is so constructed that the side nearest the play polarity at it's top 41 as the top 41 of the play piece 40. the hand held mover object 42 is brought into close proximity of the magnet play piece 40, the play piece is repelled away from the mover object 42, since the frictional resistance force to the advancement of play piece 40 along the game board 20 playing surface 22 is less than the resulting magnetic replusion force emitted between the hand held mover object 42 and play piece 40.

It can also be appreciated that unlike other prior art games where the playing objects are moved by hand, the use of a magnetic type mover object 42 requires a certain amount of skill and therefore presents an interesting challenge for the operator to master. While I have disclosed as my preferred embodiment the use of a mover object 42 in the form of a ring, it should also be understood that the mover object may take any other form which can accommodate the use of a permanent magnet, such as a pistol or finger, depending on the game board logo.

Referring now to FIG. 4, where a fragmentary cross section view of the game board 20 is shown, it can be seen that as the mover object 42 is brought into the close proximity to magnetic play piece 40 the play piece is repelled in the direction of the arrow toward a light play position 33 having a reed switch 51 in an open position.

As the playing piece 40 advances along the game board 20 playing surface 22 its magnetic flux permeates the game board 20 playing surface 22 medium which causes a reed switch 51 to close thus completing the electrical circuit with the light bulb 50 and energy source 52, as can best be seen in FIG. 3. Once the reed switch 51 is closed, the electrical circuit for the light play position 33 is completed and the light bulb 50 is energized. As the light from the bulb 50 permeates the medium of the translucent playing surface 22, a message in the form of words, colors, or drawings is communicated to the operator of the mover object 42.

The message may be printed on a colored plastic or acetate type transparent film 26 disposed between the bottom of the playing surface 22 and the light bulb 50. It should also be appreciated and understood that the desired game design 21 may be printed or inlaid directly on either the top or bottom of the entire playing surface 22, by means of a clear plastic or acetate type material, well known in the art.

While I have in the above discussion of this invention used the term "magnet", "permanent magnet", "magnetic" or "magnetic material", I do not intend to limit the meaning to only a particular form of magnet or magnetic monolithic material composition since other forms, such as: bar, ring, horseshoe, and electro-magnets may also be used and different composite materials containing both magnetic and non-magnetic components may be used provided a repelling magnetic force is emitted.

It can be appreciated that the use of a permanent magnet in both the playing piece 40 and mover object 42 to move the playing piece 40 and to light up a plurality of game board play positions 30, results in an extremely intriguing and entertaining game and requires the operator to exercise considerable judgment and skill in its execution.

RULES OF PLAY

The following description will explain the rules of my game in general terms, however, it should be understood that the rules may be modified for use in a variety of games distributed under different logotype or seasonal versions thereof, such as: Christmas, Easter or Halloween.

The object of the game is to move a magnet play piece 40 from the start position 31 along a given path of play positions 30 having various consequences associated with a landing thereon, to the finish position 32.

Two or more players may compete, with the first player reaching the finish position 32 or spin saucer space becomes the winner of the game.

Figure 11:
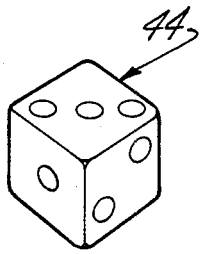
FIG. 11 is a perspective view of a die playing device.

To start, each player is given a play piece 40 and then takes a turn throwing the die 44, as best seen in FIG. 11. The player with the highest die 44 number starts first by activating the game board 20 electrical circuit by means of an on/off switch 27 located on the outside frame 24 of the game board. The first player then throws the die 44 again and moves the play piece 40 by means of a mover object 42 the number on the die 44, without touching the playing piece 40. As my preferred embodiment I have in FIG. 10 shown the mover object 42 as a ring, which the player would place on his or her finger before attempting to advance the playing piece along the game board 20. Should a player cause the playing piece 40 to flip over, the player will receive a penalty of one turn and must correct the positioning of the play piece and proceed to the correct play position 30, associated with the number shown on the die. The balance of the players each receive their turn in a clockwise rotation from the first player.

Figure 6:
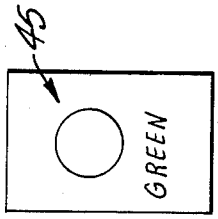
FIG. 6 is a plan view of one of a green spot draw card.
Figure 7:
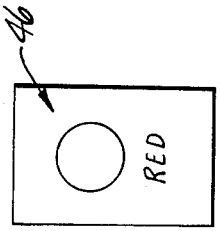
FIG. 7 is a plan view of a red spot draw card.
Figure 8:
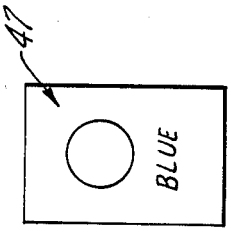
FIG. 8 is a plan view of a blue spot draw card.

The game board 20, design 21 has a plurality of different kinds of playing positions, viz.: white space 60, green space 61, and special space 62 which have specific instructions associated therewith should the players playing piece 40 advance thereto. During the advancement of the playing piece 40 across the various playing positions 30 the player may be able to collect and save draw cards such as: a green spot 45, red spot 46, and blue spot card 47, shown in FIGS. 6, 7, 8, and other cards (not shown).

The first player who reaches the finish position 32 (spin saucer space) and then matches the spinner 34 hole 35 color with a color spot card which the player has accumulated during the game is the winner. Should the player on his/her first attempt fail to match either the spinner 34 color with color spot card, or has no colored draw cards the player would keep spinning the spinner 34 or pick a draw card, as the case may be, in sequence order with the other players, until matching the spinner hole 35 color with a color spot card.

It will be appreciated that numerous changes and modifications can be made to the embodiments disclosed herein and to the rules of play, without departing from the spirit and scope of this invention. By virtue of the above-described construction and rules of play the objectives of the invention listed above and numerous additional advantages are attained.

I claim:

1. A game apparatus, comprising:

a. a game board having a frame;

b. a horizontal translucent playing surface secured to said frame of the game board having an array of playing positions from start to finish thereon;

c. a horizontal nontranslucent bottom secured to said frame of the game board under said translucent playing surface;

d. a spacer being disposed between said horizontal translucent playing surface and said nontranslucent bottom;

e. a plurality of magnetic playing pieces, said playing pieces each having the same polarity at their tops;

f. a mover object said mover object having magnetic means for advancement of said playing pieces along said playing surface;

g. a plurality of light means secured to said horizontal nontranslucent bottom disposed under a plurality but less than all, of said playing positions, said light means having a reed switch, lightbulb and energy source in a closed circuit, said light means being activated as said mover object causes a magnetic playing piece to advance into certain playing positions on said game board;

h. a switch secured to the game board to activate the energy source and i. a spinner having blue, red and green holes therein secured to the top surface of said game board, adjacent to the finish playing position;

j. whereby said magnetic playing pieces being advanced over the array of play positions by the magnetic repulsive forces emitted from said playing pieces and said mover object as said mover object is brought into close proximity thereto.

2. A game apparatus as defined in claim 1, further comprising:

a colored plastic film being secured to the bottom of said horizontal translucent playing surface above said plurality of light means.

3. A game apparatus as defined in claim 2, wherein said magnet playing pieces have a pawn shape.

4. A game apparatus as defined in claim 3, wherein said switch means is secured to the outside of said frame of the game board.

5. A game apparatus as defined in claim 4, wherein said light means energy source consists of DC battery current.

6. A game apparatus as defined in claim 4, wherein said light means energy source consists of standard AC household electrical current.

7. A game apparatus as defined in claim 1 wherein the magnetic means of said mover object comprises a permanent magnet disposed therein with the same polarity at its top as the top of said magnetic playing pieces.

8. A game apparatus as defined in claim 7, wherein the electrical circuit of the light means is an electrical series circuit.

9. A board game apparatus including, in combination:

a. a board having a array of translucent playing spaces constituting a path or course extending about said board;

b. the playing spaces having respective designations for: start, finish, white, green, and CD;

c. a spinner having blue, red, and green holes therein said spinner being secured to the top surface of said board adjacent to the finish space;

d. a spinner indicator secured to the top surface of said board adjacent to said spinner;

e. draw cards having red, blue, and green spots thereon used to match the color holes of said spinner as designated by said spinner indicator;

f. a plurality of light means located under certain, but less than all, of said playing spaces secured to said board game, said light means having an on/off switch, reed switch, lightbulb, and energy source in a closed circuit;

g. a plurality of magnetic playing pieces, said playing pieces each having the same polarity at their top, said playing pieces being used for movement between the array of playing spaces in accordance with the rules of the game;

h. a mover object, said mover object having magnetic means for advancing said magnetic playing pieces along the array of playing spaces, said light means being activated as said mover object causes the advancement of a magnetic playing piece into certain playing spaces on said board.

10. A board game apparatus as defined in claim 2, wherein said mover object magnetic means comprises a permanent magnet disposed within said mover object having the same polarity at its top as the top of said playing pieces.

11. A board game apparatus, as defined in claim 10, wherein said mover object consists of a ring shaped object having a magnet disposed therein.

12. A board game apparatus, as defined in claim 10, wherein said mover object consist of a finger shaped object having a magnet disposed therein.

13. A board game apparatus as defined in claim 10, further comprising means for determining by chance the extent of each said playing piece movement along the array of playing spaces.

14. A board game apparatus as defined in claim 13, wherein said means for determining by chance the extent of each said playing piece movement is by a die.

15. A board game apparatus as defined in claim 13, wherein said mover object consist of a ring shaped object having a magnet disposed therein.

16. A board game apparatus as defined in claim 13, wherein said mover object consist of a finger shaped object having a magnet disposed therein.

17. In a board game apparatus:

a. a board having a plurality of playing positions consitituting a path or course extending about said board, the playing positions having respective designations for start, finish, light, white, green and CD;

b. a spinner having blue, red, and green holes therein, said spinner being secured to the top surface of said board near the finish space;

c. a die to determine the extent of the players movement along the plurality of playing spaces;

d. a spinner indicator secured to the top surface of said board adjacent to said spinner;

e. draw cards having red, blue, and green spots thereon used to match the color holes of said spinner as designated by said spinner indicator, said cards to be drawn by players as determined by chance;

f. means for lighting certain, but not all, of said plurality of playing positions, said means for lighting being secured under said board;

g. a plurality of magnetic playing pieces, said playing pieces each having the same polarity at their top; and h. a mover object, said mover object having a magnet disposed therein so that its top has the same polarity as the top of said playing piece, said light means being activated as said mover object causes the advancement of a magnetic playing piece into certain playing positions on said board;

i. whereby said playing pieces being advanced over the playing positions by the magnetic repulsive flux emitted from said magnetic playing pieces and mover object as said mover object is brought into close proximity during the game play.

18. A board game apparatus as defined in claim 17, wherein said means for lighting comprises an on/off switch, reed switch, light bulb, and energy source, 19. A board game apparatus as defined in claim 18, wherein said mover object consists of a ring shaped object having a magnet disposed therein.

20. A board game apparatus as defined in claim 18, wherein said mover object consists of a finger shaped object having a magnet disposed therein.

21. A board apparatus, comprising:

a. a frame;

b. a playing surface secured to said frame having an array of playing positions from start to finish thereon;

c. a bottom secured to said frame below said playing surface;

d. magnetic playing pieces having a top portion, said playing pieces having disposed therein a permanent magnet so that all of said playing pieces have the same polarity at their tops;

e. a mover object having a top portion, said mover object having disposed therein a permanent magnet, the permanent magnet being so positioned in said mover object that its top has the same polarity as the top of said playing pieces;

f. light means secured to said bottom under a plurality of certain, but not all, of said playing positions, said light means being activated as said mover object causes the advancement of a magnetic playing piece into certain playing positions on said game board; and g. a spinner secured to the top of said playing surface ; whereby said playing pieces being advanced over the array of playing positions by the magnetic repulsive flux emitted from said magnetic playing pieces and mover object as said mover object is brought into close proximity during the game play.

22. A game board apparatus as defined in Claim 2, wherein said light means comprises a closed electrical series circuit with a reed switch, lightbulb and energy source.

* * * * *